US005567033A

United States Patent [19]

Tanaka et al.

[11] Patent Number: 5,567,033

[45] Date of Patent: Oct. 22, 1996

[54] VEHICULAR HEADLAMP HAVING THERMALLY PROTECTED FRONT LENS

[75] Inventors: Toshio Tanaka; Takaaki Nishizawa, both of Shizuoka, Japan

[73] Assignee: Koito Manufacturing Co., Ltd., Tokyo, Japan

[21] Appl. No.: 419,694

[22] Filed: Apr. 11, 1995

[30] Foreign Application Priority Data

Apr. 15, 1994 [JP] Japan ..... 6-101568

[51] Int. Cl.[6] ..... F21M 3/14

[52] U.S. Cl. ..... 362/61; 362/303; 362/346

[58] Field of Search ..... 362/61, 80, 303, 362/305, 364, 373, 294

[56] References Cited

U.S. PATENT DOCUMENTS 3,486,019 12/1969 Bryant et al. ..... 362/303
4,271,459 6/1981 James ..... 362/346
4,931,912 6/1990 Kawakami et al. ..... 362/61
5,067,054 11/1991 Oshio et al. ..... 362/61
5,111,368 5/1992 Suzuki et al. ..... 362/61
5,195,815 3/1993 Watanabe et al. ..... 362/61

*Primary Examiner*—James C. Yeung
*Attorney, Agent, or Firm*—Sughrue, Mion, Zinn, Macpeak & Seas

[57] ABSTRACT

A vehicular headlamp including a lamp body, a lens formed of resin which covers a front opening of the lamp body, a reflector disposed in a lamp chamber defined by the lamp body and the lens, an electric bulb supported by the reflector, and a substantially cylindrical shade formed of metal and surrounding the bulb for shielding light emitted from the bulb and directing a part of the light toward a part of the reflector other than an effective reflection region thereof. The lens is inclined with respect to the optical axis of the headlamp. The shade has a cut-out portion for transmitting light emitted from the bulb through a side part thereof, and the shade is provided with an inclined portion at a front end portion thereof shaped so as to correspond to the shape of the inclined lens surface.

7 Claims, 7 Drawing Sheets

VEHICULAR HEADLAMP HAVING THERMALLY PROTECTED FRONT LENS

BACKGROUND OF THE INVENTION

The present invention relates generally to a vehicular headlamp and, more particularly, the invention relates to a vehicular headlamp having a lens inclined with respect to an optical axis, and in which a metallic shade, provided for shielding an electric bulb so as to prevent the light from the bulb from being directed in undesired directions and functioning as a secondary light source, is prevented from deforming the lens.

In a vehicular headlamp, for example, an automobile headlamp, light emitted from an electric bulb is reflected by a reflector, and the reflected light is projected and controlled by a lens to obtain a desired light distribution pattern.

If light from the bulb is directed toward portions of the reflector other than the effective reflection region of the reflector, it is difficult to control the reflected light. Consequently, a shade has been used for shielding light which o is directed toward portions of the reflector other than the effective reflection region.

FIG. 9 shows an example of such a conventional automobile headlamp having a shade. The conventional headlamp includes an electric bulb a supported by a reflector b, a metallic shade c surrounding the electric bulb a and having an approximately cylindrical shape. The shade c is provided with a cut-out (not shown) on a side portion d thereof which allows light emitted from the bulb a and passing through the cut-out to be directed toward only the effective reflection region of the reflector b. The headlamp also has a lens e formed of a synthetic resin, which lens is inclined with respect to the direction of the optical axis X—X. With this structure, the light emitted from the electric bulb a is directed only toward the effective reflection region of the reflector b so that the light can be properly controlled by the lens e.

With the conventional automobile headlamp constructed as described above in which the lens e is inclined with respect to the direction of the optical axis X—X, since an end portion of the shade c is positioned close to the lens e, the lens may be deformed due to heat. In other words, when the bulb is lit, the shade c is heated by the bulb a to a very high temperature. Accordingly, if the shade c is positioned too close to the lens e formed of synthetic resin, the shade c, acting as a secondary heat source, may deform a part of the lens e which is closely adjacent thereto.

Heretofore, as shown in FIG. 10, there has been proposed another type of headlamp in which an end part f of a shade g has a curved shape such as circular or oblong in cross section. In this type of headlamp, the end part f of the shade g can be positioned far from the lens e compared to the former conventional shade, thus suppressing deformation of the lens e due to heat. However, there arises another problem in that the volume of the chamber surrounded by the shade g where the electric bulb a is disposed is made excessively small, as a result of which the temperature in the chamber becomes so high as to shorten the lifetime of the electric bulb a.

SUMMARY OF THE INVENTION

The present invention was made in view of the foregoing problems accompanying the conventional headlamp having a shade.

Therefore, it is an object of the invention to provide a headlamp capable of preventing a lens from being deformed by a shade due to heat without shortening the lifetime of a bulb.

The above and other objects can be achieved by the provision of a vehicular headlamp which, according to the present invention, includes a lamp body, a lens formed of resin which covers a front opening of the lamp body, a reflector disposed in a lamp chamber defined by the lamp body and the lens, an electric bulb supported by the reflector, and a substantially cylindrical shade formed of metal and positioned so as to surround the electric bulb for shielding light emitted from the bulb directed toward parts of the reflector other than an effective reflection region thereof, wherein the lens is inclined with respect to the optical axis of the lamp, the shade has a cut-out portion for transmitting light emitted from the bulb through a side part thereof, the shade being provided with an inclined portion at a front end portion thereof in such a manner that the shape of the inclined portion substantially corresponds to that of the inclined lens surface.

Therefore, in accordance with the vehicular headlamp of the present invention, since the shade has no portion which is too close to the inclined lens, the lens suffers substantially no deformation due to heat. Further, since the shade has a substantially cylindrical shape and since the portions of the shade which would otherwise be close to the lens are cut out or inclined and remaining portions are far from the lens, there is no danger of damage to the lens. Moreover, the volume of the portion where the electric bulb is disposed is not overly small.

DESCRIPTION OF THE PREFERRED EMBODIMENTS

Figure 1:
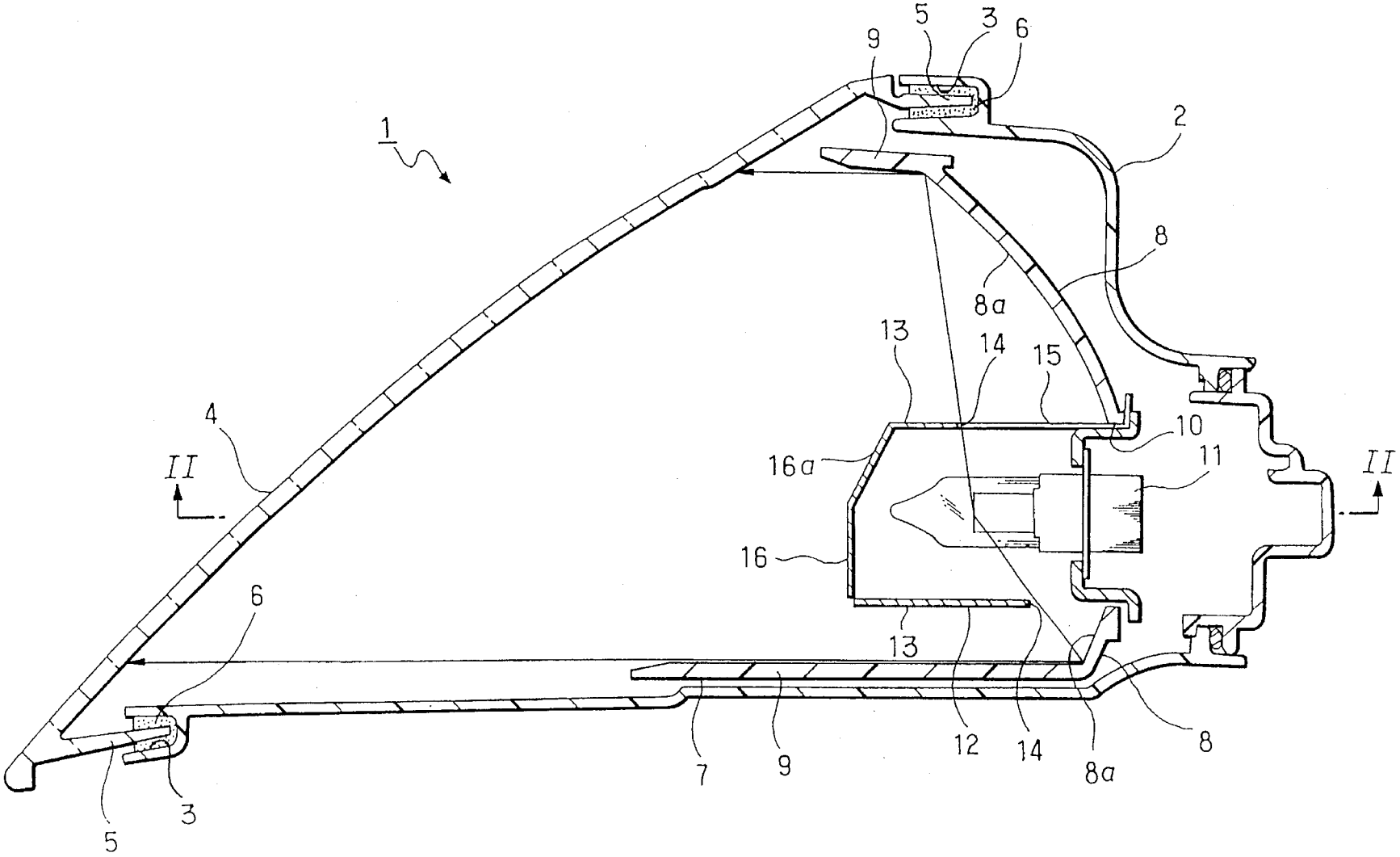
FIG. 1 is a sectional view showing a preferred embodiment of the present invention wherein the vehicular headlamp of the present invention is applied as an auxiliary headlamp for an automobile.
Figure 2:
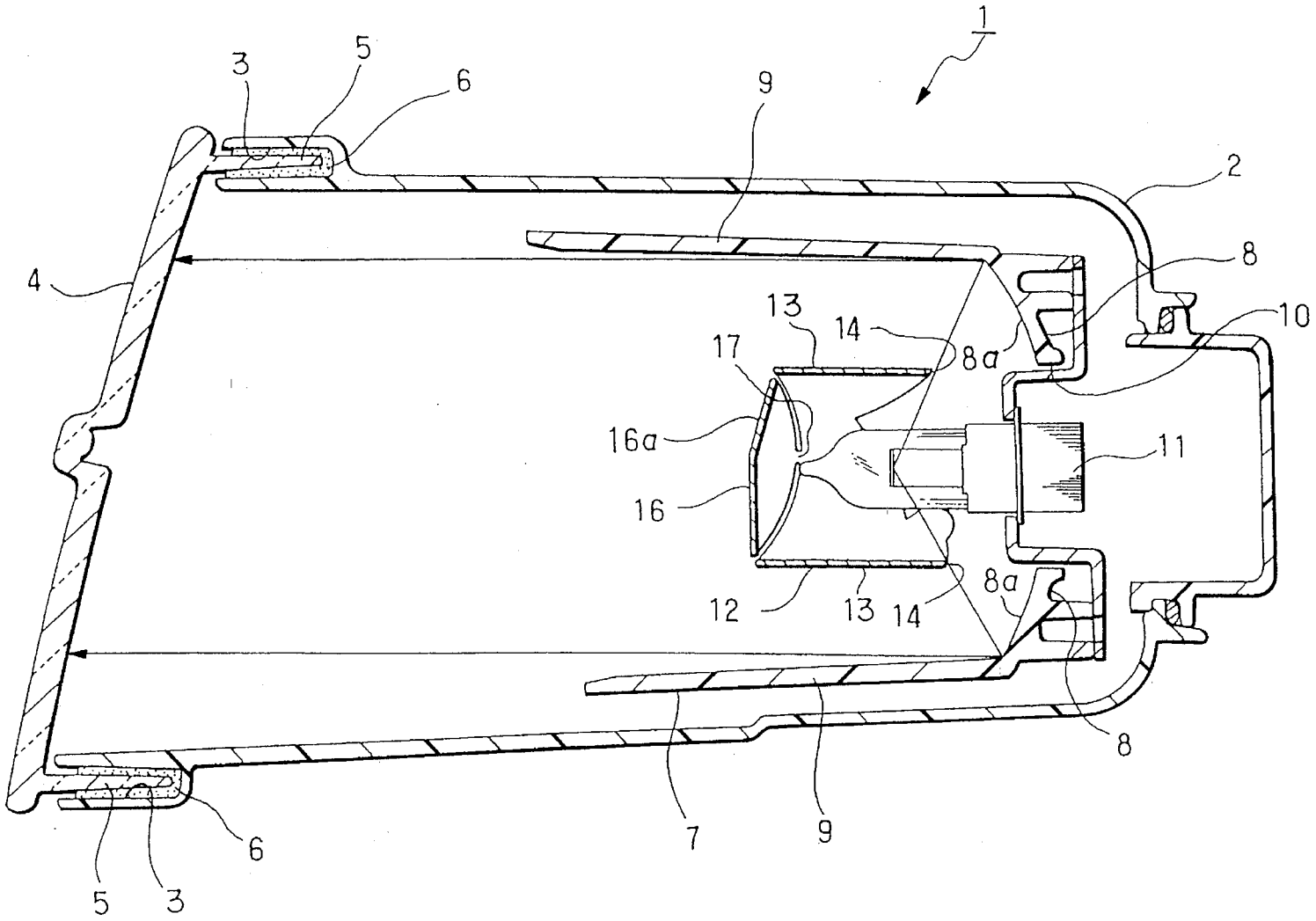
FIG. 2 is a sectional view taken along line II—II in FIG. 1.
Figure 3:
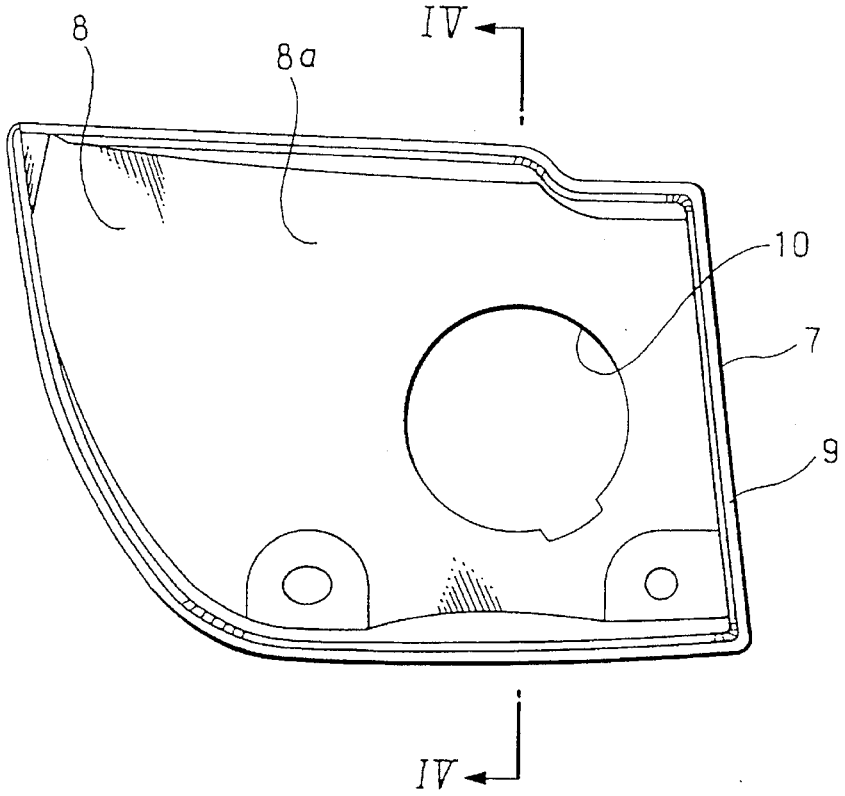
FIG. 3 is a front view of a reflector.
Figure 4:
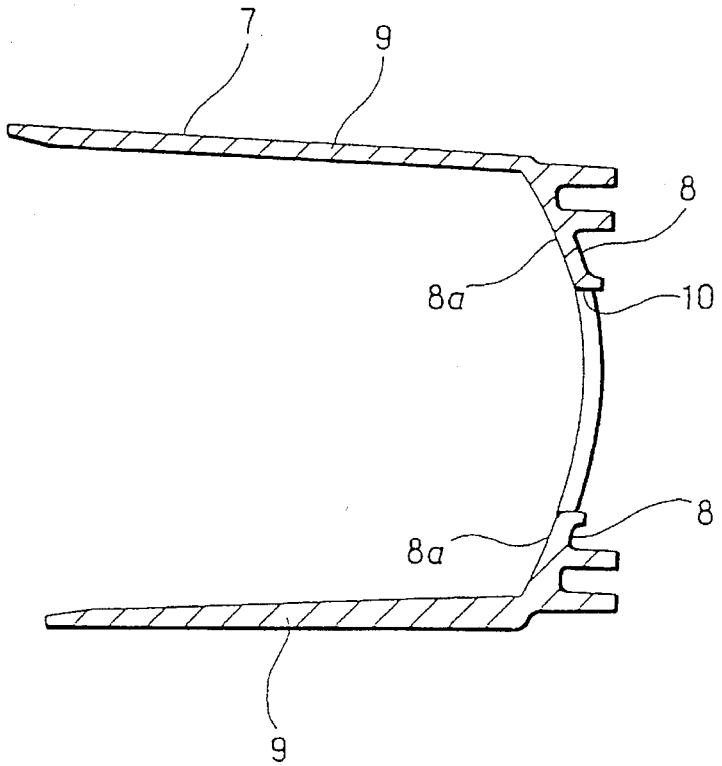
FIG. 4 is a sectional view taken along line IV—IV in FIG. 3.

A preferred embodiment of a vehicular headlamp constructed according to the present invention will be described in detail with reference to the accompanying drawings.

Referring to the drawings, reference numeral 1 designates an automobile headlamp, for example, an auxiliary headlamp in the form of a fog lamp, having a lamp body 2.

The lamp body 2 is formed of synthetic resin. The lamp is cup-shaped having an opening directing frontward. In the drawing of FIG. 1, the leftward direction corresponds to the front of the lamp, the rightward direction corresponds to the back side of the lamp, the upward direction corresponds to the right side thereof, the direction toward the paper surface corresponds to the upper portion of the lamp, and the direction toward the back of the paper corresponds to the lower portion thereof. (The directions mentioned hereinbelow relate to the aforementioned directions.)

The opening of the lamp body 2 is inclined in the lateral direction in such a manner that the leftmost end thereof is located at the frontmost end of the lamp and the rightward direction extends rearward. In addition, the opening is inclined also in the vertical direction in such a manner that the upward side thereof extends rearward. The lamp body is provided at an opening periphery thereof with a mounting groove 3.

Reference numeral 4 designates a lens made of a transparent synthetic resin such as polycarbonate, acrylic resin, or the like. On an inner surface of the lens, lens steps (not shown) are formed for controlling the reflected light from the reflector mentioned herein. Further, the lens 4 is provided with a mounting leg 5 which projects rearward from the rear surface of the periphery thereof. The lens 4 is mounted in the opening of the lamp body 2 while inserting the mounting leg 5 of the lens 4 into the mounting groove 3 of the lamp body 2. The mounting leg 5 is secured and sealed to the lamp body by means of a hot melt 6. Otherwise, the lens 4 can be fixed to the lamp body 2 with screws or by caulking.

A reflector 7 formed of synthetic resin is constituted by a rear reflection part 8 and peripheral wall part 9 extending toward the front from peripheral edges of the rear reflection part 8. The rear reflection part 8 and the peripheral wall part 9 are integrally formed. The inner surface 8 *a*of the reflection part 8 is formed in a curved shape which constitutes a part of a parabolic surface and which is formed as a reflection surface by aluminum deposition or the like. The front edge of the peripheral walls part 9, i.e., the opening periphery of the reflector 7, is inclined so as to be offset toward the rear as it extends toward the right.

On the reflection part 8 of the reflector 7, a bulb mounting hole 10 is formed so that an electric bulb 11 can be detachably engaged with the hole 10.

The reflector 7 with the attached bulb 11 is supported within a lamp chamber defined by the lamp body 2 and the lens 4 by a support mechanism (not shown) so that the reflector 7 is adjustably tiltable within the lamp chamber.

A substantially cylindrical shade 12 having a closed front end is formed of a metal sheet material. The shade 12 is provided with a cut-out 14 on a side surface part 13 thereof. Attachment legs 15 extend rearward from an edge of the cutout 14 of the side surface part 13. The rear ends of the attachment legs 15 are supported by the opening periphery of the hole 10 for attaching the electric bulb 11.

The shade 12 thus formed is disposed so as to cover front and side parts of the bulb 11 so that light emitted from the bulb 11 is directed toward the effective reflection region of the reflector 7, that is, the reflection surface 8 *a*. In other words, light directed from the electric bulb 11 to regions other than the effective reflection region 8 *a*of the reflector 7 is shielded by the shade 12.

The front surface 16 of the shade 12 is inclined so that approximately half of the right side of the front surface is directed rearward as it extends toward the right, whereas the portion is slightly directed rearward as it extends upward.

Figure 5:
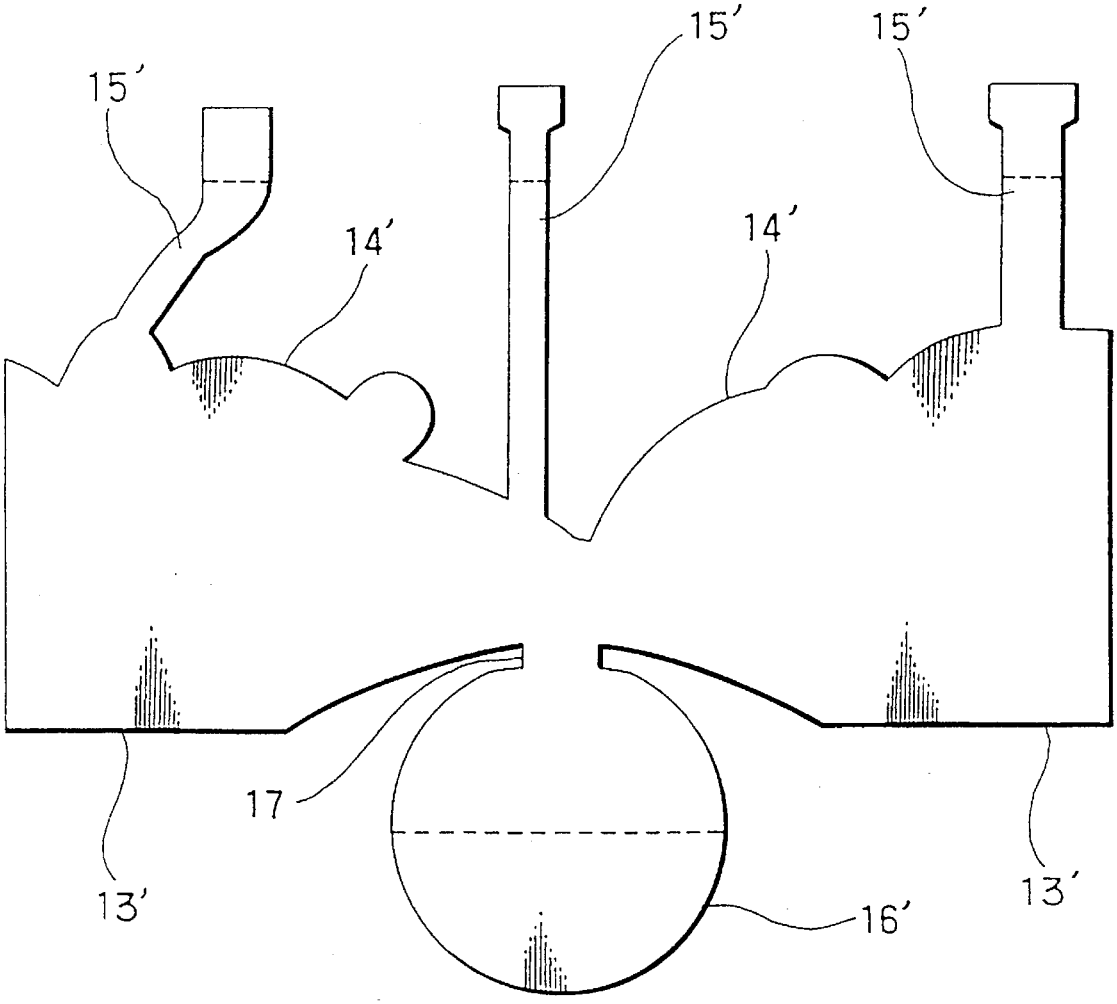
FIG. 5 is an exploded view showing a shade together with FIGS. 6 and 8.
Figure 6:
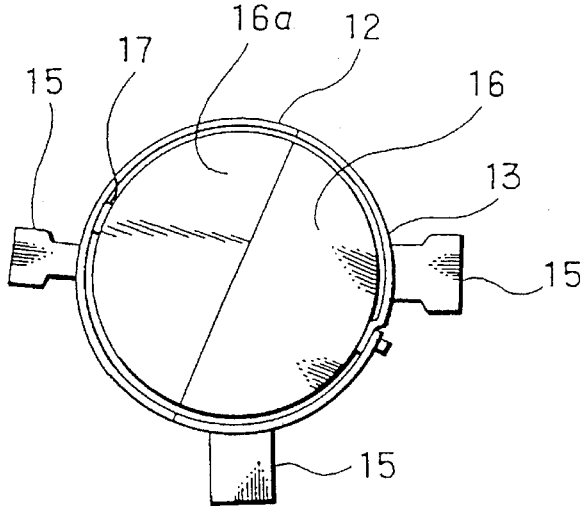
FIG. 6 is a front view of the headlamp of FIG. 1.
Figure 7:
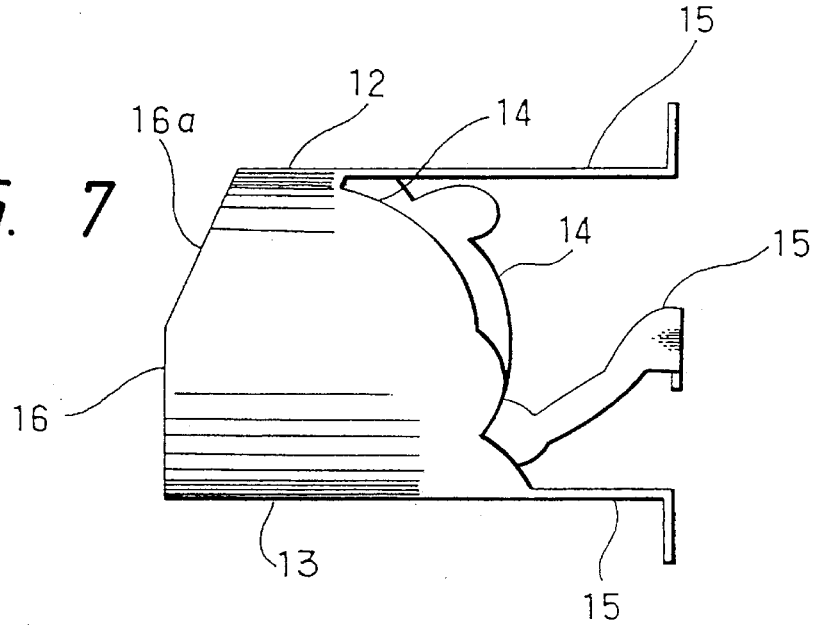
FIG. 7 is a plane view of the headlamp of FIG. 1.
Figure 8:
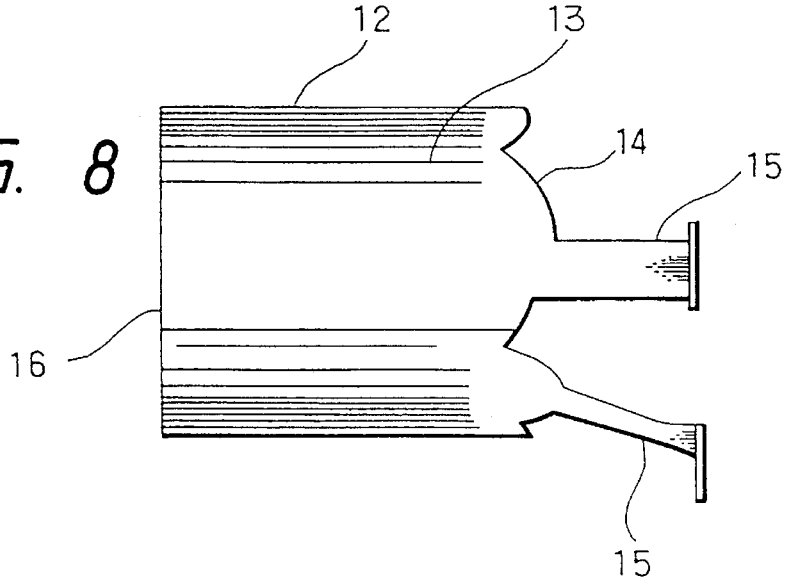
FIG. 8 is a right side view of the headlamp of FIG. 1.
Figure 9:
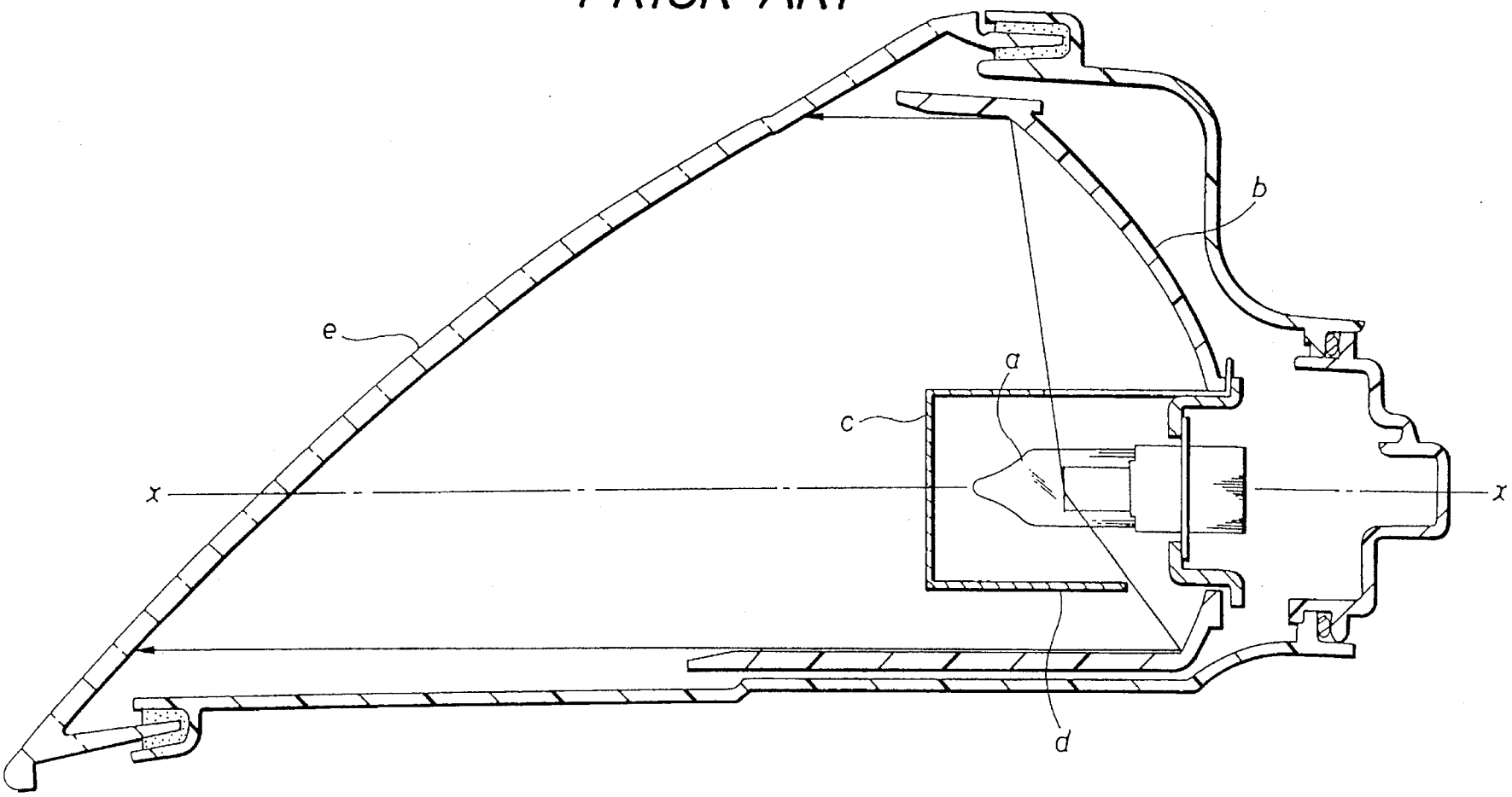
FIG. 9 PRIOR ART
FIG. 9 is a sectional view showing an example of a conventional vehicular headlamp.
Figure 10:
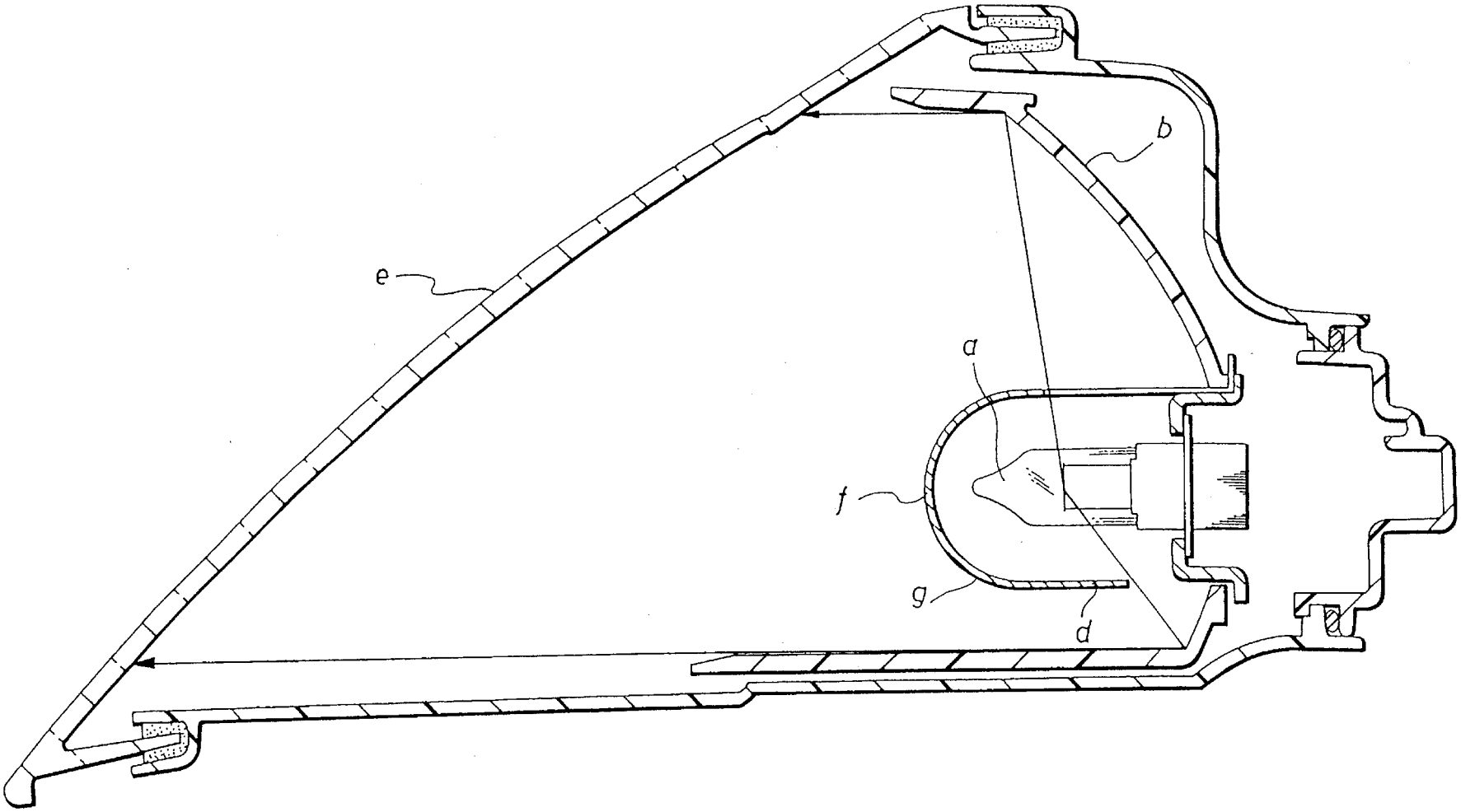
FIG. 10 is a sectional view showing another embodiment of a conventional vehicular headlamp.

The shade 12 may be formed, for example, by cutting a single piece of sheet metal material to form a side surface forming portion 13' and a front surface forming portion 16', as shown in FIG. 5, in such a manner that the side surface forming portion 13' and the front surface forming portion 16' are integrally connected at a continuous piece 17. The side surface forming portion 13' is curled into a cylindrical shape to connect the ends thereof to each other, thereby forming a side surface part 13, whereas the front surface forming portion 16' is bent at the continuous piece 17 to cover the front surface of the side surface part 13.

Accordingly, in the aforedescribed auxiliary headlamp 1, when the bulb 11 is turned on, although light emitted from the bulb 11 is either directed to the front or toward the side, a part of the light is shielded by the front surface part 16 and the side surface part 13 of the shade 12. Only light passing through the cut-out 14 is directed toward the effective reflection region 8 *a*of the reflector 7. As a result, light reflected by the effective reflection region 8*a*constitutes a substantially parallel light beam which passes through the lens 4 and is projected.

Although the lens 4 is inclined in such a manner that the right side thereof is relatively close to the heat sources, that is, the bulb 11, which is the primary source, and the shade 12, which is the secondary source, since the lens 4 either extends to the right or extends upward, there is no danger of deformation or damage to the lens. The front surface part 16, which affects the lens 4 as the secondary light source, is inclined so that approximately half 16*a*of the right side thereof is directed rearward as the front surface part 16 extends to the right or extends upward. Owing to this arrangement, the front surface part 16 is prevented from being too close to the lens 4, and, therefore, the lens 4 is prevented from being deformed due to heat.

The vehicular headlamp according to the present invention includes a lamp body, a lens formed of resin which covers a front opening of the lamp body, a reflector disposed in a lamp chamber defined by the lamp body and the lens, an electric bulb supported by the reflector, and a substantially cylindrical shade formed of metal surrounding the bulb for shielding light emitting from the bulb and directing the light toward a part of the reflector other than an effective reflection region thereof, wherein the lens is inclined with respect to the optical axis of the lamp, the shade has a cut-out portion for transmitting light emitted from the electric bulb through a side part thereof, and the shade is provided with an inclined portion at a front end portion thereof in such a manner that the shape of the inclined portion of the shade substantially corresponds to that of the inclined lens surface.

Therefore, in accordance with the vehicular headlamp according to the present invention, since the shade has no portion which is too close to the inclined lens, the lens is protected from deformation due to heat. Further, since the shade has a substantially cylindrical shape and since the portions of the shade which would otherwise be close to the lens are cut out or inclined and remaining portions are far from the lens, there is no danger of damage to the lens. Moreover, the volume of the portion where the electric bulb is disposed is not overly small.

It should be understood that the form of the invention herein shown and described is to be taken as a preferred example of the invention and that various changes in the shape, size and arrangement of parts may be resorted to without departing from the spirit of the invention or the scope of the subjoined claims.

What is claimed is:

1. A vehicular headlamp comprising:

a lamp body having a front opening;

a lens covering said front opening of said lamp body, said lens being inclined with respect to an optical axis of said headlamp;

a reflector disposed in a lamp chamber defined by said lamp body and said lens, said reflector comprising an effective reflection region;

an electric bulb supported by said reflector; and a substantially cylindrical shade for shielding light emitted from said bulb and directing said light toward a part of said reflector other than said effective reflection region thereof, said shade comprising a cut-out portion formed at a side part thereof for transmitting light emitted from said bulb and an inclined portion at a front end portion of said shade, the shape of said inclined portion substantially corresponding to a shape of said inclined lens surface.

2. The vehicular headlamp according to claim 1, wherein said lens is formed of resin.

3. The vehicular headlamp according to claim 2, wherein said lens is formed of polycarbonate.

4. The vehicular headlamp according to claim 2, wherein said lens is formed of acrylic resin.

5. The vehicular headlamp according to claim 1, wherein said shade is formed of metal.

6. The vehicular headlamp according to claim 5, wherein said shade is formed by cutting and bending a single sheet of metal.

7. The vehicular headlamp according to claim 6, wherein said shade is formed by cutting said single metal sheet material to form a side surface forming portion and a front surface forming portion, said side surface forming portion and said front surface forming portion being integrally connected as a continuous piece, said side surface forming portion being curled in a cylindrical shape to connect ends thereof to each other, and said front surface forming portion being bent at said continuous piece to cover a front surface of said side surface part.

* * * * *